US006099149A

United States Patent [19]

Chappell

[11] Patent Number: 6,099,149

[45] Date of Patent: Aug. 8, 2000

[54] INTEGRATED CLAMPING/SUPPORT/CORD STORAGE ASSEMBLY

[76] Inventor: Gilmore H. Chappell, 6210 Christian St., Philadelphia, Pa. 19143

[21] Appl. No.: 09/003,976

[22] Filed: Jan. 7, 1998

[51] Int. Cl.[7] ..... F21V 21/08

[52] U.S. Cl. ..... 362/396; 362/387; 362/430; 248/229.23

[58] Field of Search ..... 362/387, 396, 362/427, 399, 418, 269, 288, 430; 248/229.23, 231.51, 316.1

[56] References Cited

U.S. PATENT DOCUMENTS

| | | | |
|---|---|---|---|
| 3,341,701 | 9/1967 | Moore et al. . | |
| 3,591,116 | 7/1971 | Dalum | 248/166 |
| 3,618,885 | 11/1971 | Muller | 248/460 |
| 3,872,428 | 3/1975 | Boisvert | 362/396 |
| 4,399,498 | 8/1983 | Bacevius | 362/396 |
| 5,320,150 | 6/1994 | Everts et al. | 144/287 |

*Primary Examiner*—Stephen Husar

*Attorney, Agent, or Firm*—Susan B. Evans; Susan Borden Evans Associates

[57] ABSTRACT

A drop cord extension light having a light assembly with a grippable handle portion and a lamp and reflector swingably mounted thereto. A support swingably mounts the handle enabling the light and reflector to be rotated in mutually orthogonal directions relative to the axis of rotation of the support. A clamping/stand assembly has a pair of arms swingably mounted to opposite ends of the support. Torsion springs are also swingably mounted to the support and in a first position clamp the support arms together and in a second position release the support arms so that they may be swung open to assume an inverted, V-shaped configuration serving as a support stand for the lamp assembly. The lamp may be swung to a position between the arms of the support stand when not in use and an extension cord wrapped about the arms and the lamp assembly thereby storing the electric cord in a neat, compact manner and further encircling and protecting the lamp and reflector. The support may be used to swingably support a housing for receiving devices other than drop cord lights.

20 Claims, 6 Drawing Sheets

INTEGRATED CLAMPING/SUPPORT/CORD STORAGE ASSEMBLY

FIELD OF THE INVENTION

The present invention relates to support assemblies and more particularly to a novel clamping/supporting/cord storage assembly for instruments and devices such as drop cord lights.

BACKGROUND OF THE INVENTION

Drop cord lights are well-known and find a wide variety of applications and are thus popular among both amateurs and professionals, and is especially useful in dark or poorly lit areas.

Drop cord lamp assemblies are typically comprised of a metallic reflective portion having a grid-like protective shield across the front end of the reflector, which reflects light from a bulb toward an object or area to be illuminated. The bulb is screwed into a socket at the base of the protective assembly. A spring loaded clamping assembly is often provided as an integral part of the assembly for releasably securing the clamping assembly to a support within the region to be illuminated. A universal joint, such as a ball and socket joint couples the lamp assembly to the clamp. Alternatively or, in addition to the clamping assembly, the drop cord assembly is often provided with a hook at the upper end of the reflector to hook the lamp to a convenient support. The lamp assembly is powered by coupling an electrical cord to an electrical outlet. The cord is typically anywhere from six (6) to twenty (20) or more feet in length, enabling the lamp to be used to illuminate areas which may be somewhat remote from an electrical outlet.

Drop cord lamp assemblies of the type described have disadvantages in that, in the absence of a support upon which to mount the clamp, there is no adequate, self-contained means for setting up the drop cord assemblies so that the lamp is properly oriented to direct light to the area of interest. In such situations, the user is obliged to hold the lamp in one hand, which handicaps the user in the performance of inspection, maintenance or repair activities, necessitating the use of both hands. In addition, the universal joint becomes totally useless in such situations.

Although the lamp assembly may be placed in the ground, there is no adequate means to orient the lamp and reflector and this is not a useful position to illuminate regions or objects located well above the ground.

In addition, separate and independent means is required for neatly and compactly wrapping the electric cord when not in use.

BRIEF DESCRIPTION OF THE INVENTION

The disadvantages of conventional drop cord lamp assemblies are overcome by the novel support/clamping/cord storage assembly of the present invention, which is characterized by comprising a lamp stand assembly capable of assuming a substantially V-shaped configuration serving as a support or stand for the lamp. The lamp stand assembly swingably mounts the lamp assembly at the apex of the V-shaped configuration, the lamp stand assembly further being pivotally mounted about a longitudinal axis enabling orientation of the lamp in two (2), mutually orthogonal directions.

The lamp stand may be supported upon any suitable support such as a table, floor or other similar surface without the need for clamping.

Specially adapted torsion spring members releasably secured to the V-shaped supporting stand may be secured thereto in one orientation to maintain the stand in its V-shaped configuration, and may be shifted to a second position in which the V-shaped stand is resiliently urged to a collapsed position serving as a clamping assembly for clamping the lamp assembly to a suitable support in much the same manner as conventional clamping assemblies. The collapsed position also renders the drop cord lamp assembly more compact to facilitate its transportation and/or storage.

The dual purpose stand, when collapsed, enables the lamp assembly, which is swingably mounted thereto, to be swung to a position where it is substantially surrounded by and thereby protected by both the lamp stand and the electric cord when it is wrapped about the stand. The lamp handle, when in the collapsed position, is easily gripped in one hand to facilitate handling and transportation thereof. The stand, which is a wire-like structure, is provided with specially adapted bent corner portions, each of which serves as a means for releasably clamping a free end of the electric cord to maintain the cord in its compact, wrapped condition when not in use, and without the need for separate tying means.

The stand, whether oriented in the V-shaped configuration to serve as a stand or in the collapsed position to serve as a clamping support, provides a mounting assembly for the lamp assembly enabling the lamp assembly to be oriented in any desired position in order to direct light to a desired area or to illuminate a desired object as well as eliminating the need for the user or the user's assistant to hold the lamp.

The wire-like stand structure provides suitable supporting and structural strength for the lamp assembly while at the same time providing a substantially lightweight stand assembly.

The support/damping/cord storage assembly may be used to support any objects or instruments requiring such capabilities.

OBJECTS OF THE INVENTION

It is therefore one object of the present invention to provide a novel stand assembly for instruments such as extension lamps and the like, which serves the dual function of providing a supporting stand and a clamping stand to accommodate the needs of the user.

Still another object of the present invention is to provide a novel stand assembly for instruments such as electrical lamp assemblies and the like which utilizes torsion springs, which when clamped to the wire-like stand in a first manner provides a substantially V-shaped stand structure and when coupled to the wire-like stand structure and a second manner provides a resilient clamping structure for clamping the stand to a suitable support or post.

Still another object of the present invention is to provide a novel stand capable of assuming a V-shaped support stand orientation for a clamping means and including lamp support means for orienting the lamp in mutually orthogonal directions.

Still another object of the present invention is to provide a novel combination extension lamp and stand assembly capable of either supporting the extension lamp upon a suitable support surface or alternatively clamping the stand to a suitable support or post and further serving as a means for neatly and compactly wrapping an electrical cord there about, the stand and wrapped cord cooperating to protect the lamp assembly portion.

Still another object of the present invention is to provide a novel wire-like stand assembly for supporting and orienting an extension lamp and having a portion thereof bent in such a manner as to serve as a releasable clamping means for retaining the electric cord in its compact, wrapped condition without the need for separate clamping means and further without the need for tying the lamp cord to the stand.

DETAILED DESCRIPTION OF THE INVENTION AND PREFERRED EMBODIMENTS THEREOF

Figure 1:
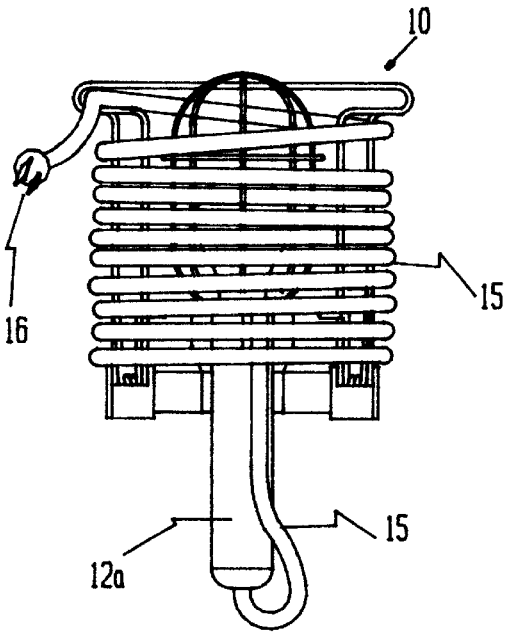
FIG. 1 is a plan view of a combined extension lamp and stand showing the electric cord wrapped about the stand and reflector portion of the lamp.

The novel apparatus 10 of the present invention is shown, for example, in FIGS. 1–4 and is comprised of a lamp assembly 12 swingably mounted to a support assembly 14.

Lamp assembly 12 is comprised of a handle portion 12*a*. One end of an electric cord 15 extends into the bottom end of handle 12*a* and is coupled to a bulb socket (not shown), the other end being provided with an electric plug 16 for insertion into an electric wall outlet, for example. Cord 15 typically ranges from six (6) to twenty (20) feet in length.

The upper end of handle 12*a* is provided with a conventional bulb socket, now shown for purposes of simplicity, which receives a light bulb 17. A reflector 12*b* has its lower end swingably secured to handle portion 12*a* and serves to reflect light from bulb 17 upon an object or area to be illuminated. The bulb is protected against damage or breakage by reflector 12*b* as well as a giid-like protective frame 12*c* secured to reflector 12*b* as shown at 12*c*-1, the reflector 12*b* and protective grid-like frame 12*c* substantially enveloping bulb 17.

Figure 2:
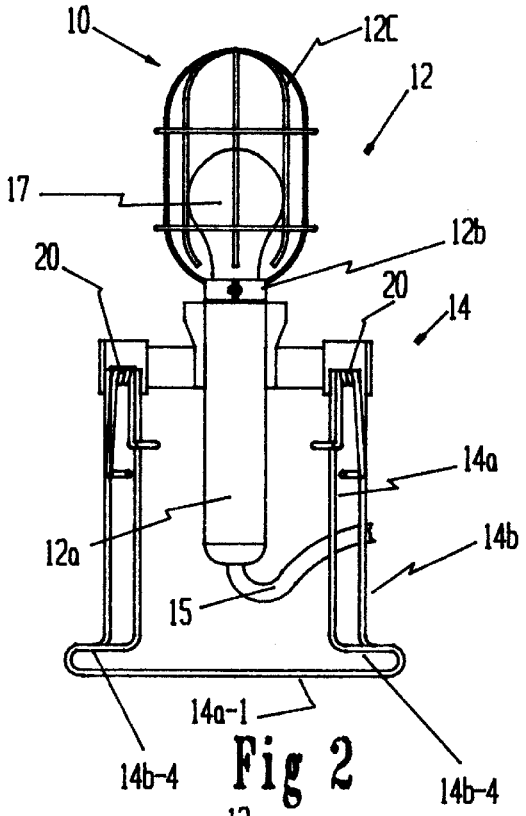
FIG. 2 is a front elevational view showing the stand with torsion springs coupled thereto in a manner to place the stand in a condition for operating as a clamping assembly.
Figure 14:
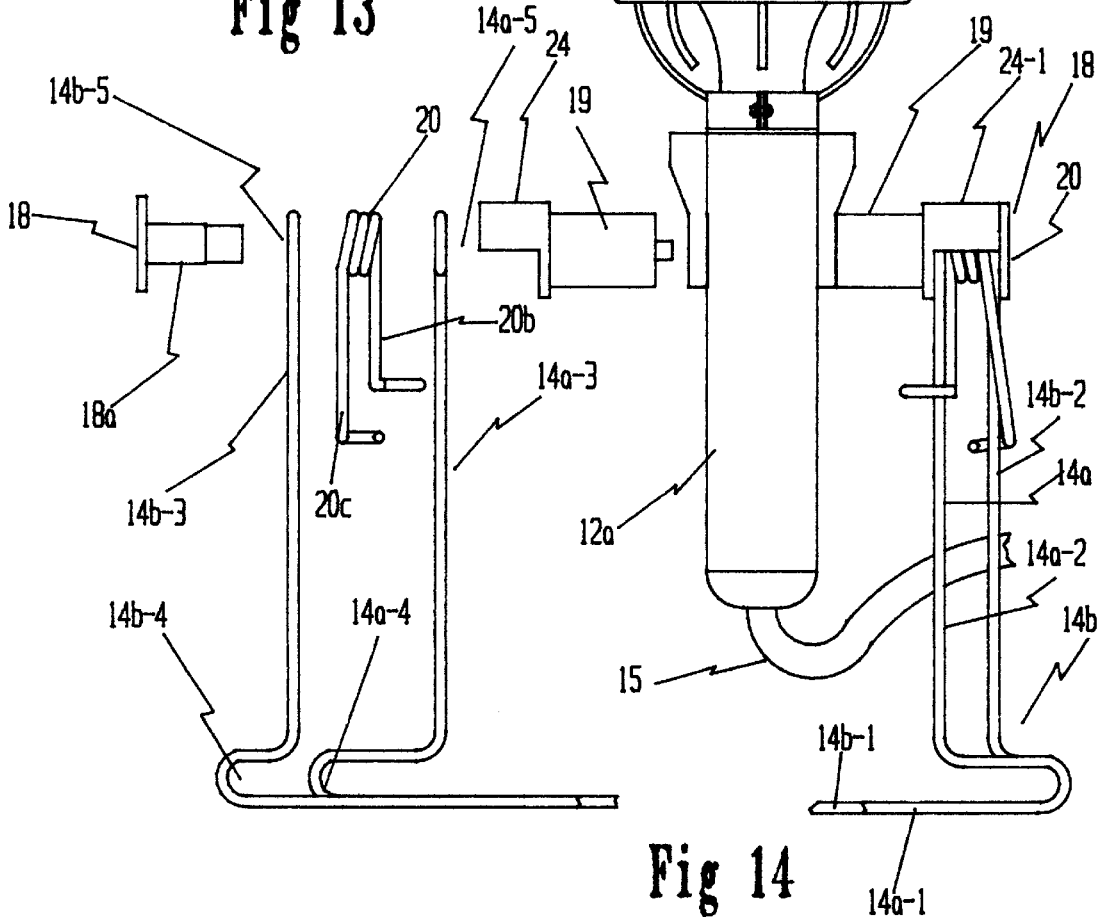
FIG. 14 is an exploded view of the stand and lamp assembly showing the individual components in greater detail.

Support assembly 14 is comprised of a pair of wire-like members 14*a*, 14*b* bent to form a substantially rectangular-shaped configuration as shown best in FIGS. 2 and 14, the members 14*a* and 14*b* each having a substantially linear intermediate portion 14*a*1–14*b*1 each being integrally joined to a pair of arms 14*a*-2/14*a*-3 and 14*b*-2/14*b*-3. The intermediate portion and arms are bent in their joined region to provide a narrow substantially U-shaped clamping portion such that, when the wire-like members 14*a*, 14*b* are brought together in the manner shown in FIGS. 9 and 10, the cooperating clamping portions 14*a*-4 and 14*b*-4 are aligned with one another as shown in FIG. 2 to jointly cooperate to receive a portion of the electric cord which is force-fitted therein in the manner shown in FIG. 1 to maintain the cord clamped to both arms of the support without the need for separate fastening, clamping or tying means, the clamping means being an integral part of the support 14. Cord 15 is simply pushed into one of the U-shaped cord clamping portions often being wrapped about the sides 14-2/14*a*-3 and 14*b*-2/14*b*-3 of members 14*a* and 14*b*. Force-fitting the cord 15 into the cooperating clamping portions also serves to retain the wire-like members 14*a*, 14*b* in the filly collapsed position (i.e. adjacent to one another).

The free, upper ends of the support arms are bent into a circular shape to receive the hollow cylindrical-shaped portion 18*a* of a hollow insert member 18 (see FIGS. 13 and 14) for swingably supporting the upper ends of the support members 14*a*, 14*b*. Noting, for example, FIG. 14, and FIGS. 9 and 10, hollow, cylindrical-shaped insert member 18 is inserted through circular-shaped ends 14*a*-5, 14*b*-5 of members 14*a*, 14*b* (note also FIGS. 9 and 10). The right-hand end 18*a* of hollow insert member 18, shown in FIG. 14, extends into hollow support housing 19, also shown in a sectional view in FIG. 13, and forms a frictional fit therein. Alternatively, the end of insert member 18 may be provided with a threaded portion to threadedly engage a tapped portion in support housing 19.

Figure 7:
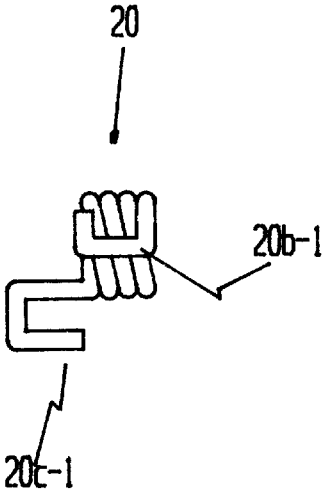
FIGS. 7 and 8 show top and side views respectively of one of the torsion springs shown in FIG. 1, for example.
Figure 8:
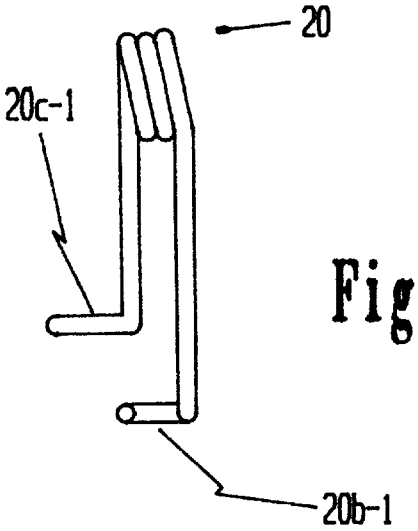
Figure 13:
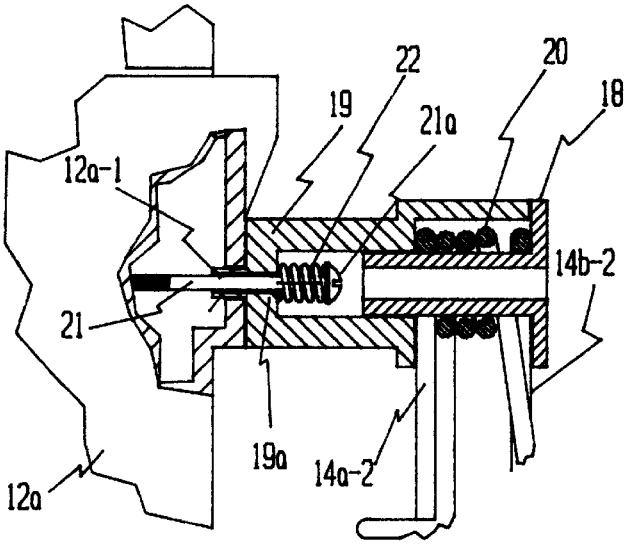
FIG. 13 is a sectional view showing the manner in which the lamp assembly is pivotally secured to the stand.

A torsion spring 20 has a helical-shaped portion 20*a* through which the insert member 18 extends, as can best be seen in FIG. 13. Helical portion 20*a* is arranged between arms 14*b*-2 and 14*a*-2 and has its arms 20*b*, 20*c* extending downwardly, as shown in FIG. 14. The free ends of arms 20*b*, 20*c* are each bent in a U-shaped configuration 20*b*-1, 20*c*-1 as shown best in FIGS. 7 and 8. Torsion spring 20 is biased in such a manner that its arms are normally urged toward alignment with one another.

Figure 9:
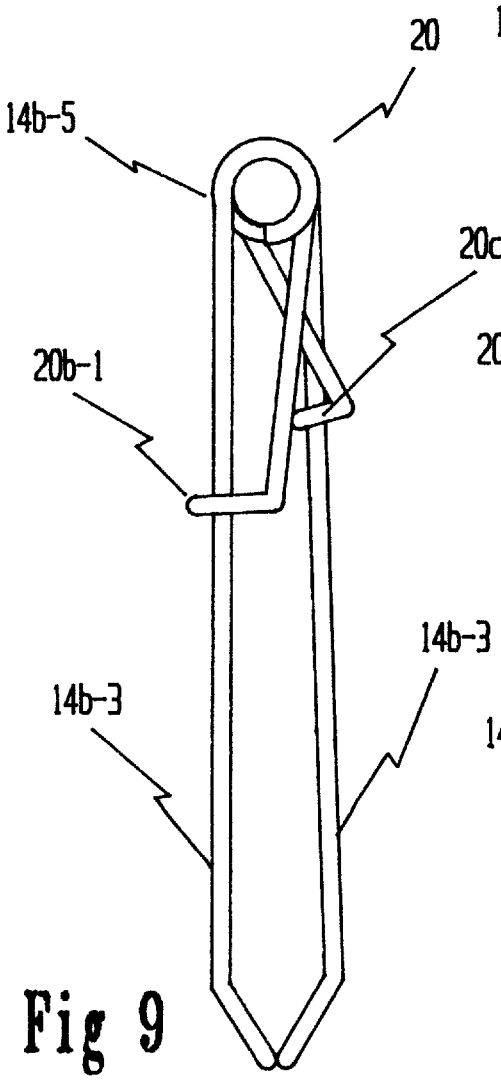
FIGS. 9 and 10 show a side view of the stand shown in FIGS. 1–6 respectively showing one of the torsion springs of FIGS. 7 and 8 occupying the clamping and non-clamping positions.

U-shaped portion 20*b*-1 receives an upper portion of arm 14*a*-3, as shown in FIG. 9. U-shaped portion 20*c*-1 has an arm portion 20*c* which is longer than arm portion 20*b*, and may be arranged to receive an upper portion of arm 14*b*-3, as shown in FIG. 9 or alternatively may be released from arm portion 14*b*-3 so as to receive a portion of arm 14*a*-3 just beneath the U-shaped portion 20*b*-1, as shown in FIG. 10.

Figure 10:
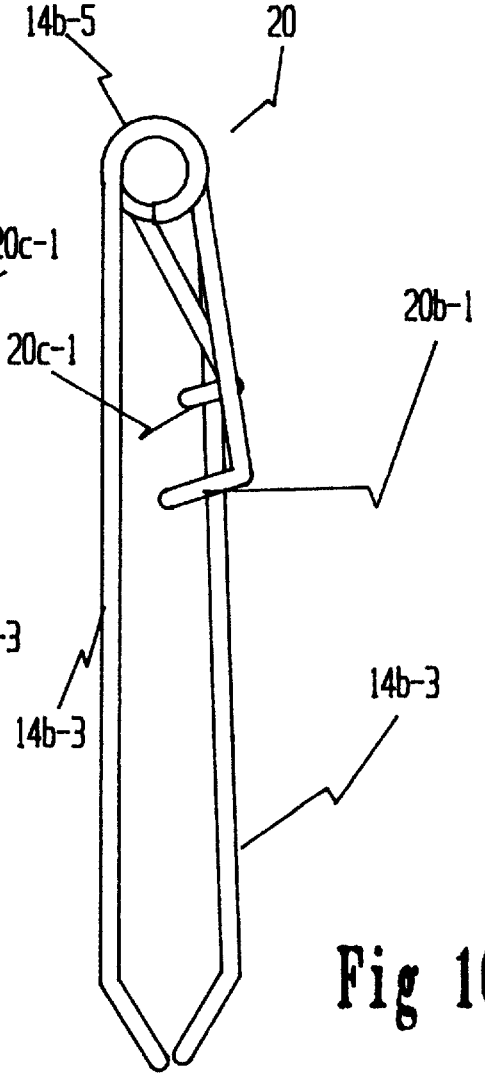

In the arrangement shown in FIG. 10, arms 14*b*-3 and 14*a*-3 are free to be swung apart about the insert member 18 which serves as a pivot axis.

Conversely, with the torsion spring 20 clamped in the manner shown in FIG. 9, arms 14*b*-3 and 14*a*-3 are swingably urged toward one another and serve as a clamping means. FIG. 10 shows the arm in a "clamped" position. In order to support assembly 14 to a suitable support, members 14*a* and 14*b* are spread apart against the force of the torsion springs 20, 20' by an amount sufficient to receive the support member S between the members 14*a*, 14*b* (see FIG. 4) whereupon the members 14*a*, 14*b* are released causing the torsion springs 20, 20' to urge the members 14*a*, 14*b* into a clamped position to secure the support assembly to support S.

Figure 4:
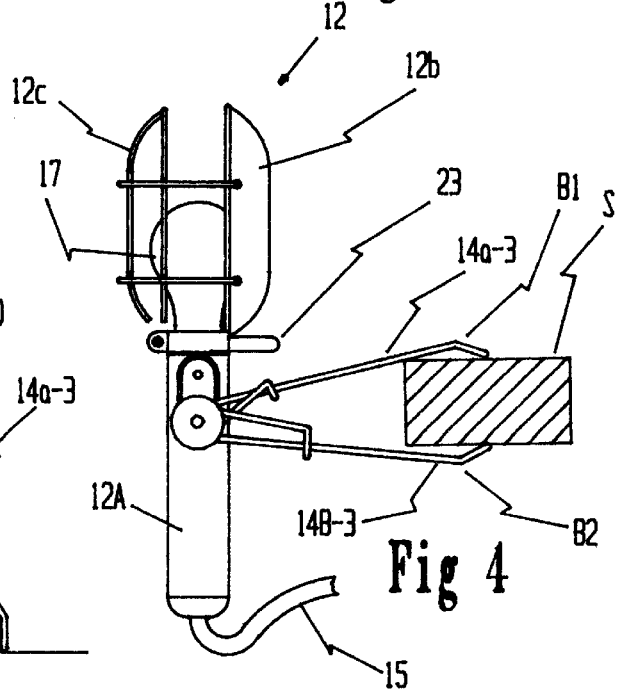
FIG. 4 shows a side elevational view of the stand in the clamping condition and being clamped upon a suitable support, with the lamp assembly arranged substantially at right angles thereto.
Figure 6:
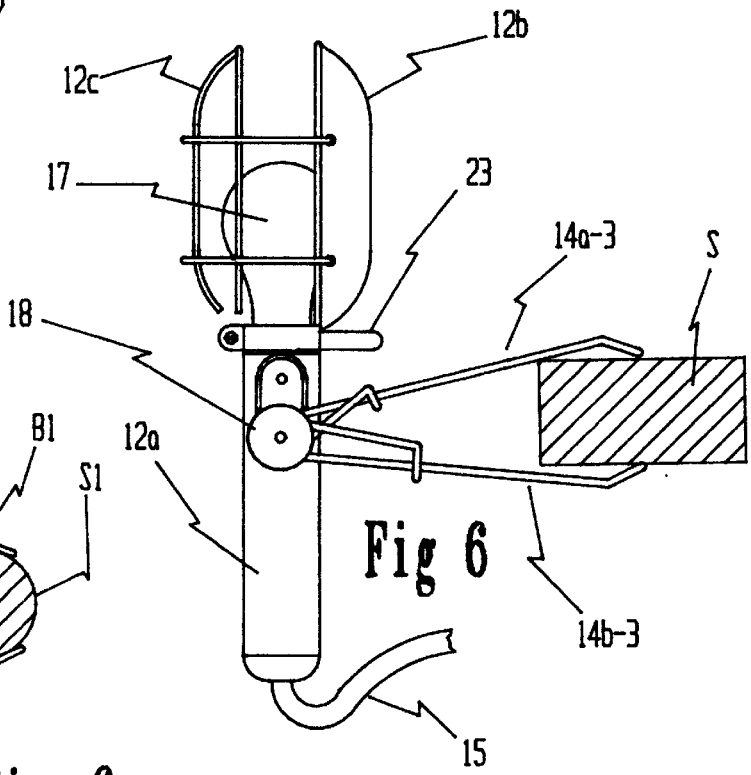
FIG. 6 shows an enlarged view of the stand and lamp assembly similar to that shown in FIG. 4.
Figure 6A:
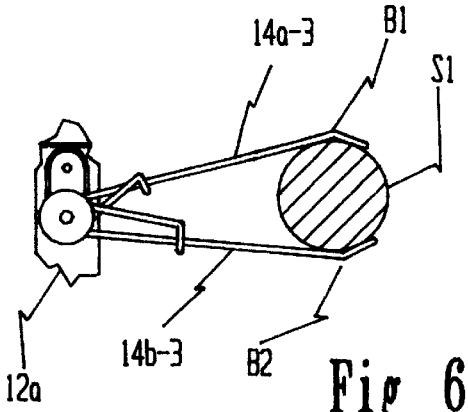
FIG. 6*a* is a side elevational view similar to FIG. 6 and showing the clamping assembly clamped to a circular-shaped support.

Each of the pair of arms of support members 14*a*, 14*b* are bent to form V-shaped bends B1, B2, shown in FIG. 4, of an obtuse angle in order to accommodate clamping to cylindrical-shaped poles or the like, as shown in FIG. 6*a*, see S1.

The lamp is movable in two (2) mutually orthogonal directions relative to stand 14 in order to direct light to a desired object or area. The lamp assembly may be pivoted about the longitudinal central axis of support housing 19 due to the pivot assembly comprised of a threaded fastener 21 which threadedly engages a tapped opening 12*a*-1 in housing 12*a*. The helical spring 22 is wrapped about threaded fastener 21 and is positioned between an opening 19*a* in hollow support housing 19, and the head 21*a* of threaded fastener 21 and serves to maintain threaded fastener 21 in a position to which it is tightened by exerting a force on head 21*a* to urge it away from the support housing opening 19*a*.

It should be understood that a similar threaded fastening member and helical spring is provided on the opposite side of housing 12*a* for swingably mounting the lamp assembly to the lamp support assembly.

The upper portion 12*b* of lamp assembly 12 is telescoped into the handle portion 12*a* and is rotatable about the longitudinal axis of handle assembly 12*a*. A pitch handle 23 mounted upon the upper lamp portion (see FIG. 5) may be manipulated by an operator to rotate the lamp and reflector assembly about the aforementioned longitudinal axis of handle portion 12*a* without requiring the user to grip or touch the reflector 12*b* or grid-like bulb protector 12*c* thereby protecting the user from coming into contact with a hot surface.

Figure 3:
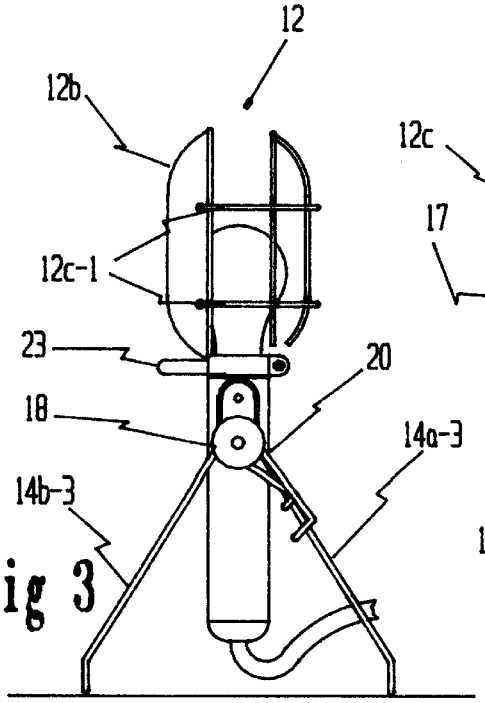
FIG. 3 shows a side elevational view of the stand in the open position to serve as a support for the lamp assembly, the stand being shown supported on a suitable support surface.
Figure 11:
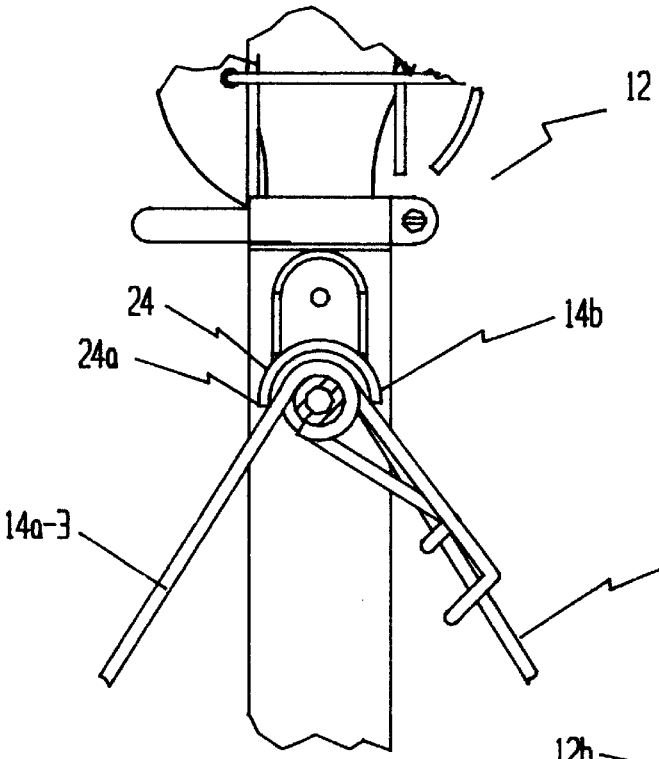
FIG. 11 shows an enlarged view of a portion of the stand and lamp assembly with an insert member being removed to expose a fender member which serves to limit the maximum angle to which the stand may be opened.
Figure 12:
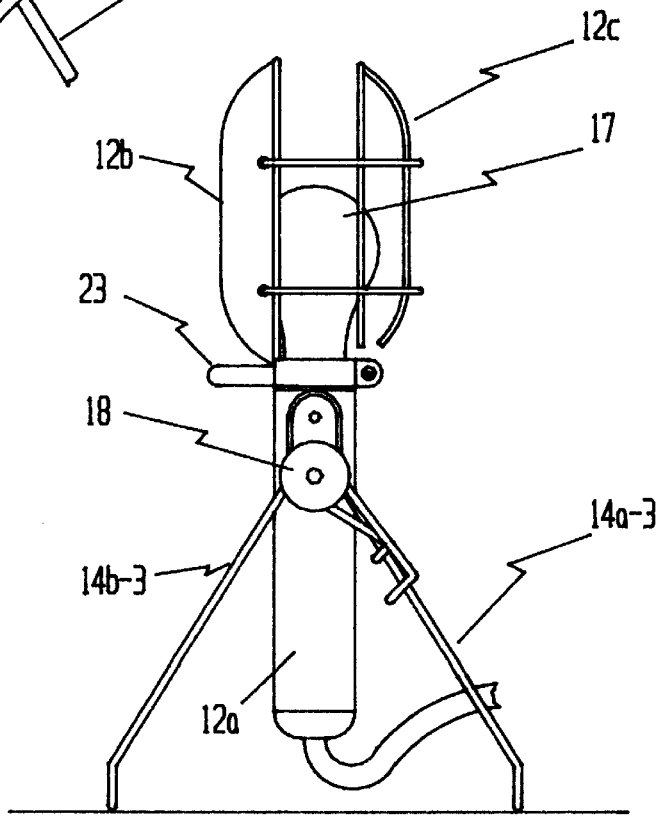
FIG. 12 shows a side view of the stand and lamp assembly with the insert member in its maximum open position.

As was set forth hereinabove, when the torsion springs 20 and 20' are arranged to have their U-shaped portions 20*c*-1, 20*c*-1' embrace arms 14*a*-3, 14*b*-3, the support members 14*a* and 14*b* are no longer urged toward one another and may be spread apart to form an inverted, V-shaped stand as shown in FIGS. 3, 11 and 12, for example.

FIG. 11 shows the lamp assembly 12 supported by the stand 14 when in the inverted V-shaped position and with the insert member 18 removed. As can best be seen in FIG. 11, a fender portion 24 of housing 19 which has an inverted, U-shaped configuration serves as a limit stop to limit the maximum angle to which the members 14*a*, 14*b* may be opened, the upper ends of the arms of members 14*a* and 14*b* abutting against the free ends 24*a*, 24*b* when the arms, such as the arms 14*a*-3 and 14*b*-3, are moved to the maximum angular separation. The bent portions of the arms such as bent portions 14*b*-5, 14*a*-5 preferably frictionally engage the outer cylindrical periphery of hollow insert member 18 so as to be maintained separated by an angle less than the maximum angular separation in case where it is desired to have the portions 14*a*, 14*b* spread apart by an angle less than the maximum spread angle. A pair of fender portions 24, 24-1 are provided at opposite ends of the support stand.

Figure 5:
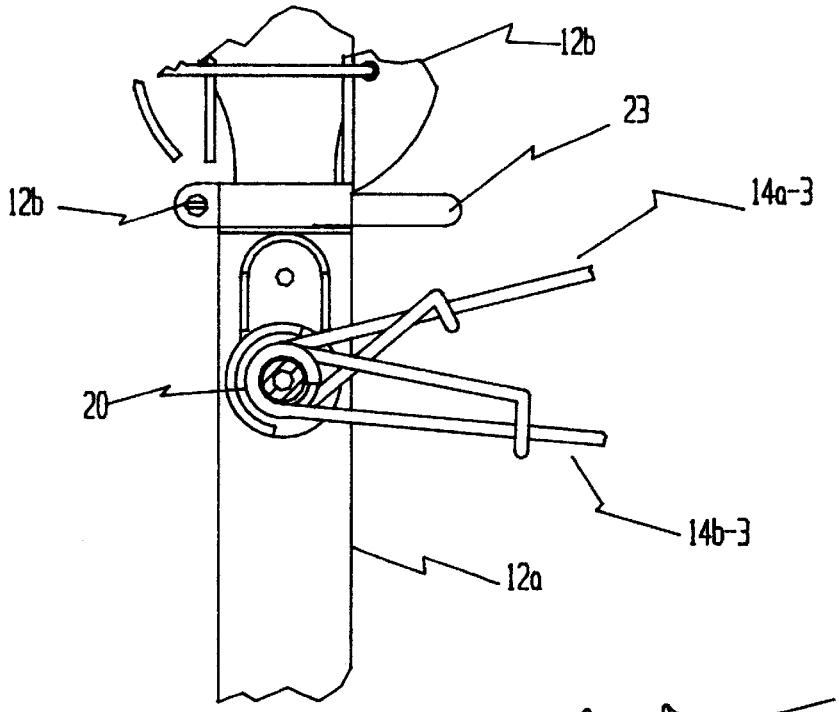
FIG. 5 shows a detailed view of a portion of the stand assembly showing one of the torsion springs and the pitch handle of the extension lamp in greater detail.

Regardless of which support orientation is utilized, i.e. either the clamping assembly shown in FIGS. 4, 5 and 6 or the support stand orientation shown, for example, in FIGS. 3, 11 and 12, the lamp may be adjustably manipulated to the desired orientation through selective gripping and moving of the handle 12*a* and pitch handle 23 without the need for touching or manipulating the heated reflector or grid protector 12*b*, 12*c*.

When the device 10 of the present invention is not in use, the handle 12*a* is gripped and rotated about the upper end of support 14 to the orientation shown in FIG. 1, moving the portion of the lamp assembly having bulb 17 within the central open region of the support 14 so that the support substantially surrounds the bulb portion. Handle portion 12*a* extends away from the support assembly 14*a*, as shown in FIG. 1, and may be gripped while the cord is wrapped about the pairs of arms of support members 14*a*, 14*b*, as shown in FIG. 1. Even though the cord may be rather long, the extent of the support arms is such as to enable the cord to be wrapped neatly and compactly about the support assembly 14, and further to envelope the bulb portion of the lamp assembly to cooperatively serve, together with members 14*a*, 14*b*, to provide further protection against damage or breakage.

The cord is preferably wrapped in such a manner that successive loops of the electric cord move progressively upwardly along the support assembly so that the free end of the cord adjacent to plug 16 is located near one of the clamping portions 14*a*-4, 14*b*-4 at opposite outside corners of the support members 14*a*, 14*b* (see FIG. 2) whereupon a portion of the free end is forced fitted into one pair of the clamping portions to retain the cord wrapped about the support assembly. As can be seen from FIG. 1, the device 10 forms a compact arrangement when not in use and may be conveniently carried by the handle 12*a*, handle 12*a* as well as pitch handle 23 being preferably formed of a suitable insulating material to protect the user from both heated portions of the lamp as well as any electrical shock.

Handle 12*a* preferably has a roughened, matte, knurled or other similar finish on its surface to facilitate gripping. Rubber or a rubber-like plastic material also provides a good gripping surface as well as providing adequate insulation from electric shock.

It can be seen from the foregoing description that the present invention provides a novel combination extension lamp and support/clamping assembly which uniquely enables an extension lamp to be oriented at a desired location so as to direct light to a desired region or upon a desired object by clamping the lamp assembly support to a suitable support or post, when available and by converting into a supporting stand when no such support or post is available, either orientation enabling the user to direct light to a desired region or toward a desired object without the need for holding either the lamp or the support and which support serves a dual function of supporting or clamping the lamp assembly in a desired location when in use and serving as a means for wrapping and storing the electric cord in a neat and compact way, and in such a manner as to provide further protection for the lamp when not in use.

Figure 15:
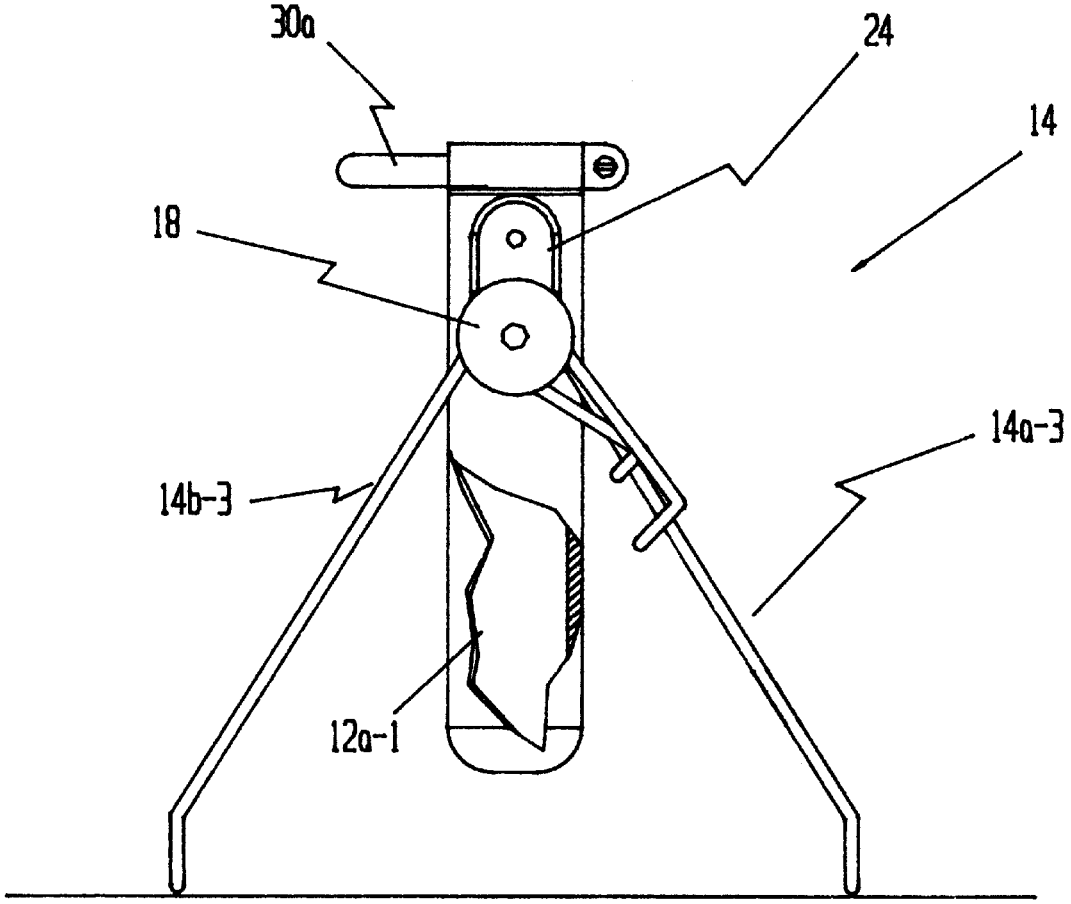
FIG. 15 is an elevational view of a support/clamping/cord storage assembly for accommodating instruments or objects other than a drop cord light.

FIG. 15 shows a support/clamping/cord storage assembly for use with instruments or objects other than drop cord lights, wherein like elements are designated by like numerals. Assembly 14 supports a hollow housing 12-1 for receiving an instrument or other object. Housing 12*a*-1 may have an opening at or near its bottom to pass an electric cord or other wire therethrough. A collar 30 of a diameter slightly smaller than the diameter of housing 12*a*-1 is telescoped into the top of housing 12*a*-1 and has an operating handle 30*a* for rotating an instrument placed therein. The instrument or like object may be clamped to collar 30 if desired or form a force-fit with the collar 30. Alternatively, the instrument or device such as a flashlight, candle, tool or the like, may be placed in housing 12-1 and the collar 30 may be omitted. The support/damping/cord storage assembly functions in the same manner as that shown in the previous figures.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described. For example, the support members may be formed of a suitable plastic (by molding). The molded members may each have an opening sufficient to enable the lamp assembly to pass therethrough and further be provided with a narrow slot-like opening for force-fittingly receiving an end of the lamp cord. If desired the bottoms of the support members need not be flat, so long as three points are provided to support the support assembly upon a surface.

What is claimed is:

1. An adjustable support structure for lamps and the like comprising:

a pair of mounting members;

a lamp structure arranged between said mounting members and being swingably mounted thereto;

first and second substantially U-shaped support members each comprised of a central portion and a first and second arms extending from opposing ends of the central portion;

free ends of first arms of said first and second members being swingably mounted to a first one of said mounting members;

free ends of the second arms of said first and second support members being swingably mounted to a second one of said mounting members enabling said U-shaped members to be swung apart to form a V-shaped configuration and swing toward one another toward a closed position;

at least one resilient member swingably mounted on one of said first and second mounting members for urging said first and second U-shaped members toward the closed position when said resilient member is in a first position and being moved from first position enabling said U-shaped members to be moved apart toward a fully opened position, said resilient member having sufficient resiliency to enable said U-shaped members to be firmly clamped to a suitable support with said support being positioned between said U-shaped members.

2. The apparatus of claim 1 wherein, when said resilient member is in said second position, said U-shaped members are movable to an inverted, V-shaped position to serve as a support for the lamp structure.

3. The apparatus of claim 2 wherein, a fender member is provided on at least one of said mounting members for limiting an angle to which the U-shaped support members may be spread apart.

4. The apparatus of claim 1 further comprising said lamp structure being swingably mounted to said mounting members to rotate about the longitudinal axis thereof.

5. The apparatus of claim 4 wherein said lamp structure further comprises:

a handle assembly;

a light bulb and a reflector arranged on the handle assembly for reflecting light from the bulb in a given direction; and means for swingably mounting said reflector to said handle assembly enabling the reflector to be rotated about a central axis of the handle assembly orthogonal to a central axis of said support member.

6. The apparatus of claim 5 further comprising an insulating pitch arm for rotating said reflector, said pitch arm being formed of a suitable insulating material.

7. The apparatus of claim 5 wherein said lamp handle assembly is formed of a suitable insulating material and having a gripping surface to facilitate gripping and handling thereof.

8. The apparatus of claim 1 further comprising an electric cord electrically connected to a lamp socket for said bulb at one end and having an opposite end provided with an electric plug for removable insertion into an electric socket.

9. The apparatus of claim 8 wherein said lamp assembly may be swingably mounted so as to position the bulb and reflector between said U-shaped arms whereby said electric cord is wrapped about said arms so as to substantially encircle the bulb portion of the lamp assembly, thereby serving the dual functions of storing the cord in a wrapped, compact manner and protecting the bulb and lamp assembly.

10. The apparatus of claim 9 wherein at least one of said U-shaped support members is bent at at least one portion thereof where said central portion joins one of said first and second arms to define a second U-shaped portion for force-fittingly receiving said electric cord to thereby secure the electric cord wrapped about the stand.

11. The apparatus of claim 1 comprising a second resilient member swingably mounted to a remaining one of said first and second mounting members and cooperating with said one resilient member for urging said first and second U-shaped members toward the closed position when said resilient member is in a first position and being moved from first position enabling said U-shaped members to be moved apart toward a fully opened position, said second resilient member having sufficient resiliency to enable said U-shaped members to be firmly clamped to a suitable support with said support being positioned between said U-shaped members.

12. The apparatus of claim 1 wherein said resilient member is a torsion spring.

13. The apparatus of claim 12 wherein said torsion spring is provided with first and second arms each having a U-shaped holding portion at the free ends thereof for releasably clamping one of the arms of said first and second U-shaped members.

14. The apparatus of claim 1 wherein said U-shaped members are elongated wire-like members bent to form said U-shaped configuration.

15. The apparatus of claim 14 wherein the free ends of the arms of said first and second U-shaped members are bent to form an opening, said resilient member being a torsion spring having a helical-shaped central portion, said helical-shaped central portion and said openings receiving a cylindrical member which is joined to said support member for swingably supporting said arms and said torsion spring.

16. The apparatus of claim 15 wherein the helical-shaped central portion of said torsion spring is positioned between the openings at the free ends of said arms.

17. The apparatus of claim 1 wherein said support members are swingably mounted to a handle portion of said lamp assembly by an elongated pin extending through said handle assembly and said support member.

18. The apparatus of claim 14, wherein said wire-like members each have at least one bent portion for force fittingly receiving the extension cord are provided at opposite ends of both said first and second U-shaped members.

19. An adjustable support structure for lamps and the like comprising:

a pair of mounting members;

a lamp structure arranged between said mounting members and being swingably mounted thereto;

first and second support members each having a first and second arms extending from a main body portion;

free ends of first arms of said first and second members being swingably mounted to a first one of said mounting members;

free ends of the second arms of said first and second support members being swingably mounted to a second one of said mounting members enabling said support members to be swung apart to form a V-shaped configuration and swing toward one another toward a closed position;

at least one resilient member swingably mounted on one of said first and second mounting members for urging said first and second support members toward the closed position when said resilient member is in a first position and being moved from first position enabling said support members to be moved apart toward a filly opened position, said resilient member having sufficient resiliency to enable said support members to be firmly clamped to a suitable support with said support being positioned between said support members.

20. An adjustable support structure comprising:

a pair of mounting members;

a housing arranged between said mounting members and being swingably mounted thereto;

first and second substantially U-shaped support members each comprised of a central portion and a first and second arms extending from opposing ends of the central portion;

free ends of first arms of said first and second members being swingably mounted to a first one of said mounting members;

free ends of the second arms of said first and second support members being swingably mounted to a second one of said mounting members enabling said U-shaped members to be swung apart to form a V-shaped configuration and swing toward one another toward a closed position;

at least one resilient member swingably mounted on one of said first and second mounting members for urging said first and second U-shaped members toward the closed position when said resilient member is in a first position and being moved from first position enabling said U-shaped members to be moved apart toward a fully opened position, said resilient member having sufficient resiliency to enable said U-shaped members to be firmly clamped to a suitable support with said support being positioned between said U-shaped members.

* * * * *